US011732934B2

(12) United States Patent
King et al.

(10) Patent No.: US 11,732,934 B2
(45) Date of Patent: Aug. 22, 2023

(54) HEAT OF COMPRESSION ENERGY RECOVERY SYSTEM USING A HIGH SPEED GENERATOR CONVERTER SYSTEM

(71) Applicants: AG Equipment Company, Broken Arrow, OK (US); TECO-Westinghouse Motor Company, Round Rock, TX (US)

(72) Inventors: Tony King, Broken Arrow, OK (US); Dean Sarandria, Jonestown, TX (US)

(73) Assignees: AG Equipment Company, Broken Arrow, OK (US); TECO-Westinghouse Motor Company, Round Rock, TX (US)

( * ) Notice: Subject to any disclaimer, the term of this patent is extended or adjusted under 35 U.S.C. 154(b) by 109 days.

(21) Appl. No.: 17/316,803

(22) Filed: May 11, 2021

(65) Prior Publication Data

US 2021/0262707 A1 Aug. 26, 2021

Related U.S. Application Data

(63) Continuation of application No. 16/380,073, filed on Apr. 10, 2019, now Pat. No. 11,015,846.
(Continued)

(51) Int. Cl.
*F25B 27/02* (2006.01)
*F25B 1/00* (2006.01)

(52) U.S. Cl.
CPC ..... *F25B 27/02* (2013.01); *F25B 1/00* (2013.01)

(58) Field of Classification Search
CPC .. F25B 27/02; F25B 1/00; F01K 25/10; F01K 7/16; F01K 13/00; F01K 21/00;
(Continued)

(56) References Cited

U.S. PATENT DOCUMENTS 6,981,377 B2 * 1/2006 Vaynberg ..... F01K 25/08 60/641.11
7,863,766 B2 1/2011 Abolhassani
(Continued)

FOREIGN PATENT DOCUMENTS

CN 101473174 7/2009
CN 101636622 1/2010
(Continued)

OTHER PUBLICATIONS

China Patent Office, Office Action dated Mar. 22, 2022 in Chinese Patent Application No. 201911326355.9 (18 pages total).
(Continued)

*Primary Examiner* — Emmanuel E Duke
(74) *Attorney, Agent, or Firm* — Trop, Pruner & Hu, P.C.

(57) ABSTRACT

A recovery system is provided to recover energy from heat. In an embodiment, the system includes an evaporator to receive a flow of natural gas at a first temperature and output the flow at a second, lower temperature. The evaporator may receive a flow of cooling media to cool the natural gas and output a flow of heated cooling media. The system may further include: a heat-to-mechanical energy converter coupled to the evaporator to receive the flow of heated cooling media and to output first cooled cooling media; an induction generator coupled to be driven by the heat-to-mechanical energy converter; a medium voltage drive coupled to receive power from the induction generator and to condition the power for output to an electrical distribution system; and a condenser to condense the first cooled cooling media to provide the flow of cooling media to the evaporator.

20 Claims, 4 Drawing Sheets

Related U.S. Application Data

(60) Provisional application No. 62/782,533, filed on Dec. 20, 2018.

(58) Field of Classification Search
CPC ..... F01K 25/08; F01K 27/02; F22B 1/1838; F04B 39/064; F04B 37/12; F04B 39/00
See application file for complete search history.

(56) References Cited

U.S. PATENT DOCUMENTS

| | | | | |
|---|---|---|---|---|
| 8,186,161 | B2 * | 5/2012 | Ast | F01K 23/101 60/660 |
| 8,575,479 | B2 | 11/2013 | Abolhassani | |
| 8,644,037 | B2 | 2/2014 | Raju et al. | |
| 9,359,915 | B2 | 6/2016 | Tomigashi et al. | |
| 9,670,799 | B2 | 6/2017 | Hashimoto et al. | |
| 10,130,016 | B2 | 11/2018 | Ledezma | |
| 10,435,604 | B2 | 10/2019 | Kontomaris et al. | |
| 10,537,046 | B1 | 1/2020 | Ledezma et al. | |
| 2002/0177092 | A1 | 11/2002 | Latzel et al. | |
| 2005/0183421 | A1 * | 8/2005 | Vaynberg | F01K 25/08 60/641.8 |
| 2010/0031677 | A1 | 2/2010 | Lifson et al. | |
| 2012/0096830 | A1 * | 4/2012 | Manoharan | F03B 13/188 60/770 |
| 2012/0192580 | A1 * | 8/2012 | Santos | F17D 1/05 165/300 |
| 2014/0208751 | A1 | 7/2014 | Bowan | |
| 2014/0366577 | A1 * | 12/2014 | Zubrin | C10L 3/10 62/619 |
| 2015/0084346 | A1 * | 3/2015 | Tomigashi | F01K 13/02 290/40 R |
| 2015/0107249 | A1 | 4/2015 | Artinian et al. | |
| 2015/0316316 | A1 * | 11/2015 | Oelfke | F25J 1/0055 62/611 |
| 2017/0350632 | A1 * | 12/2017 | Hirao | F25J 1/0269 |
| 2017/0373586 | A1 * | 12/2017 | Zhang | H02M 7/5395 |
| 2018/0258798 | A1 | 9/2018 | Oxner et al. | |

FOREIGN PATENT DOCUMENTS

| | | | | |
|---|---|---|---|---|
| CN | 102996407 | | 3/2013 | |
| CN | 104038123 | | 9/2014 | |
| CN | 104038123 | A * | 9/2014 | F01K 13/02 |
| CN | 105121981 | | 4/2017 | |
| DE | 102010056299 | | 6/2012 | |
| DE | 102012218955 | | 5/2014 | |
| GB | 2259610 | A * | 3/1993 | H01F 27/28 |
| JP | H0970172 | A * | 3/1997 | |
| RU | 2665752 | C1 * | 9/2018 | F17D 1/04 |
| WO | WO-03072384 | A1 * | 9/2003 | F01K 25/08 |
| WO | 2014043242 | | 3/2014 | |

OTHER PUBLICATIONS

China Patent Office, Office Action dated Aug. 8, 2021 in Chinese Patent Application No. 201911326355.9 (24 pages).

German Patent Office, Office Action dated Mar. 10, 2023 in German Patent Application No. 102019008252.4 (11 pages.).

* cited by examiner

HEAT OF COMPRESSION ENERGY RECOVERY SYSTEM USING A HIGH SPEED GENERATOR CONVERTER SYSTEM

This application is a continuation of U.S. patent application Ser. No. 16/380,073, filed Apr. 10, 2019, which claims priority to U.S. Provisional Patent Application No. 62/782,533, filed on Dec. 20, 2018, in the names of Tony King and Dean Sarandria, entitled "Heat Of Compression Energy Recovery System Using A High Speed Generator Converter System," the content of which is hereby incorporated by reference.

BACKGROUND

When gas is compressed in a compressor, mechanical energy is converted to heat energy. The compressed and heated gas leaves the compressor and requires the gas to be cooled before the next process. Current compression systems, specifically natural gas compressors, release all of the heat energy into the ambient air, either directly through fin fan coolers or by means of cooling water in cooling towers.

SUMMARY OF THE INVENTION

In embodiments, methods and systems are provided to recover lost energy during a compressed gas cool down process. A two-phase cooling system is used to cool the gas and convert at least some of that energy into electricity. More specifically, gas cooling is used to recover the heat by driving a turbo expander or a screw expander to convert the recovered heat to mechanical energy. The power recovery expander is coupled directly to a power generation-conversion system having a high speed induction machine and a medium voltage drive (MVD) system. In particular embodiments this MVD system may have semiconductor switching devices formed of silicon such as IGBTs or SiC devices such as MOSFETs. The MVD system interacts with the heat of compression energy recovery system to condition the generated energy and restore it back to an electrical distribution system.

In one aspect, a system includes an evaporator to receive a flow of natural gas at a first temperature and to output the flow of natural gas at a second temperature lower than the first temperature. The evaporator may receive a flow of cooling media to cool the natural gas and output a flow of heated cooling media. The system may further include: a heat-to-mechanical energy converter coupled to the evaporator to receive the flow of heated cooling media and to output first cooled cooling media; an induction generator coupled to be driven by the heat-to-mechanical energy converter; a medium voltage drive coupled to receive power from the induction generator and to condition the power for output to an electrical distribution system; and a condenser to condense the first cooled cooling media to provide the flow of cooling media to the evaporator.

In an embodiment, the heat-to-mechanical energy converter comprises an expander to reduce a pressure of the flow of heated cooling media. For high speed constructions, the expander may be a turbo or screw expander directly coupled to the induction generator. The system may further include a pump coupled to the condenser to pump the cooling media to the evaporator. The system may recover energy from the natural gas at the first temperature and provide the recovered energy to the distribution system.

In an embodiment, the system may further include a controller to control operation of the heat-to-mechanical energy converter, where the system is a heat of compression energy recovery system.

In an embodiment, the system may further include a second condenser coupled to the condenser to further condense the first cooled cooling media. This second condenser may provide a flow of second cooling media to the medium voltage drive and receive a flow of heated second cooling media from the medium voltage drive. The second condenser may further provide a flow of third cooling media to the induction generator and receive a flow of heated third cooling media from the induction generator. The system also may include at least one bypass valve which, when enabled, is to cause at least a portion of the flow of heated cooling media from the evaporator to be directed to the condenser.

In another aspect, a method includes: receiving, in an evaporator of an energy recovery system, a flow of heated material at a first temperature, cooling the heated material in the evaporator using a flow of cooling media, and outputting the flow of heated material at a second temperature lower than the first temperature; providing a flow of heated cooling media from the evaporator to an expander of the energy recovery system; driving, via the expander, an induction generator coupled to the expander using the flow of heated cooling media; and receiving, in a drive system coupled to the induction generator, power from the induction generator, conditioning the power for delivery to a distribution system, and delivering the conditioned power to the distribution system.

In an embodiment, the method may further include: outputting first cooled cooling media from the expander to a condenser coupled to the expander; and condensing the first cooled cooling media to provide the flow of cooling media to the evaporator. The method may also include reducing, in the expander, a pressure of the heated cooling media. In one embodiment, the heated material may be compressed natural gas, and the method further comprises outputting the flow of compressed natural gas at the second temperature to a distribution system. The method also may include controlling at least one of a flow rate and a pressure drop in the expander to cause a shaft of the induction generator to operate at a substantially steady rate. The method also may include: providing, from a second condenser coupled to the condenser, a flow of second cooling media to the drive system; receiving a flow of heated second cooling media from the drive system; and cooling the heated second cooling media. And, the method also may include: providing, from the second condenser, a flow of third cooling media to the induction generator; receiving a flow of heated third cooling media from the induction generator; and cooling the heated third cooling media. The method also may include controlling at least a portion of the flow of heated cooling media to bypass the expander on a path from the evaporator to the condenser.

In yet another aspect, a system includes: a compressor to compress natural gas to output compressed natural gas; an evaporator to receive the compressed natural gas at a first temperature and to output the compressed natural gas at a second temperature lower than the first temperature, the evaporator to receive a flow of cooling media to cool the compressed natural gas and to output a flow of heated cooling media; an expander coupled to the evaporator to receive the flow of heated cooling media and to output first cooled cooling media; an induction generator coupled to be driven by the expander; a medium voltage drive coupled to receive power from the induction generator and to condition the power for output to an electrical distribution system; a condenser to condense the first cooled cooling media to provide the flow of cooling media to the evaporator; and a controller to control a flow rate of the flow of heated cooling media to the expander. In an example, the controller may control a bypass system coupled between the evaporator, the expander and the condenser, where the controller is to cause at least a portion of the flow of heated cooling media to bypass the expander.

DETAILED DESCRIPTION

A heat-to-mechanical energy converter is much like a steam turbine, in that a liquid is heated until it changes from a liquid to a hot gas (like steam). This hot gas then is used to drive a turbo expander (steam turbine), resulting in cooled gas ready to be condensed. The turbo expander drives a generator that produces electricity. At a high level, a heat of compression energy recovery system includes: a gas cooling system; a heat-to-mechanical energy converter; a generator and IGBT-based MVD; and a control system.

Figure 1:
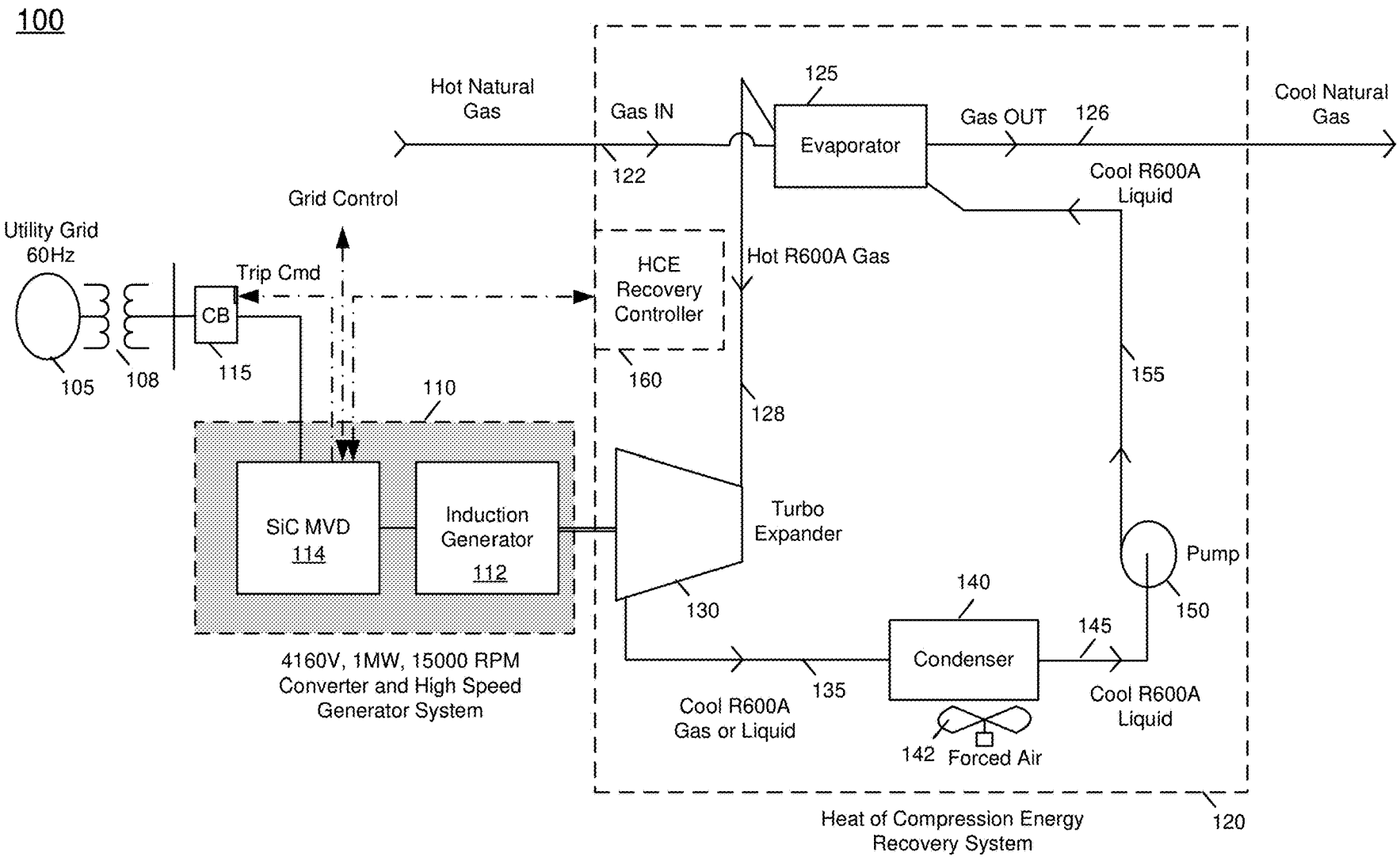
FIG. 1 is a block diagram of an energy recovery system in accordance with an embodiment.

Referring now to FIG. 1, shown is a block diagram of an energy recovery system in accordance with an embodiment. As shown in FIG. 1, energy recovery system 100 may be implemented to extract energy from a cooling process in which a heated cooling media is cooled, creating energy, which heat energy may be converted into mechanical energy. In turn, a power conversion system in accordance with an embodiment may process and provide generated electrical energy to an electrical distribution system, e.g., of the energy recovery manufacturer. In some cases, this manufacturer may in turn provide recovered electricity to a utility grid via a point of common coupling, thereby injecting electrical energy into a utility system extracted from a cooling process. Although the embodiment of FIG. 1 is for recovering energy during a compression process for natural gas, embodiments are not so limited. In other cases, electrical energy may be generated from mechanical energy obtained in other manners such as residual heat from blast furnaces, geothermal power generation or so forth.

With reference to FIG. 1, system 100 includes a converter and generator system 110 and an energy recovery system 120. With reference first to converter and generator system 110, a medium voltage drive system 114 is included. In embodiments, medium voltage drive system 114 may be implemented using one or more modular medium voltage drive systems (MVD) as described herein. In one embodiment, system 110 may operate at 4160V and 1 MW. MVD inverter topologies also may be implemented utilizing customized multi-level inverter structures such as neutral point-clamped inverter (NPC) and cascaded H-bridge inverter configurations. In a preferred embodiment, with arrangements for providing electrical energy to a utility grid 105, understand that medium voltage drive system 114 may be formed with multiple slices, each including multiple power cubes having front end stages, DC bus and back end stages. In these implementations, the back end stages may be controlled to operate as a rectifier and the front end stages may be controlled to act as inverters, in order to provide power to utility grid 105, via circuit breaker 115 at a utility frequency (e.g., 50/60 Hertz). As shown, circuit breaker 115 couples to utility grid 105 via a secondary side of a grid transformer 108 configured to step the voltage down. In other cases, the point of common coupling can be a point of coupling located remotely from a utility within a private energy distribution system of the energy recovery manufacturer.

As further illustrated, converter and generator system 110 also includes an induction generator 112, which may be a high speed medium voltage (MV) induction generator that, in an embodiment, may operate at speeds up to 15,000 RPM. Understand that higher speed applications are possible.

Still with reference to FIG. 1, energy recovery system 120 is implemented as a heat of compression energy recovery system. In embodiments, system 120 is a closed-loop system to remove the heat from a gas stream, similar to a home air conditioner. The refrigeration system in a home air conditioner uses a closed-loop system to evaporate a liquid and then condense the gas back to liquid. A simplistic explanation of this system is that an evaporator absorbs the heat from inside the house, in a process called latent heat of evaporation, and a condenser releases the heat outside the house. The condenser compresses the gas to a pressure so that the outside air is cool enough to condense it back to a liquid, thereby releasing the heat outside (latent heat of condensation). Similar techniques are used in energy recovery system 120.

With reference to FIG. 1 as shown, system 120 receives, via a conduit 122, an input of incoming natural gas at a high temperature. As examples, this incoming flow of hot natural gas may be at a temperature of between approximately 230 and 350 degrees Fahrenheit (F). The incoming hot natural gas is provided to an evaporator 125, which cools the incoming hot natural gas, using a cooling medium, to output a flow of cooled natural gas via a conduit 126, for further processing or distribution. To this end, evaporator 125 receives a flow of cooling liquid via conduit 155. In an embodiment, the cooling medium may be a given refrigerant (e.g., R600a, R134a or any other suitable refrigerant) that at this point in the cycle is a cool liquid, e.g., at a temperature of between approximately 90° and 120° F. In particular embodiments, R600a may be preferred, as it allows the expander to operate at more favorable pressures and may facilitate the expander design.

The hot natural gas heats the refrigerant past its boiling point, causing the refrigerant to evaporate, which also provides additional cooling, such that the refrigerant is now a hot gas. In an embodiment that uses R600a, evaporator 125 can operate at 288 PSIG and, as described below a condenser 140 can operate at 94 PSIG. At 288 PSIG the R600a is heated to about 220° F. to evaporate, and at 94 PSIG it can be cooled to 120° F. to condense.

Evaporator 125 may be incorporated as a shell and tube heat exchanger that cools the natural gas and heats the refrigerant. In evaporator 125, this cooling media is thus heated and exits via a conduit 128 as a heated cooling media which may be a two-phase media, namely a hot gas, e.g., at 288 PSIG 220° F. Evaporator 125 may cool the incoming natural gas to an exit temperature of between approximately 100° and 130° F.

Evaporator 125 thus absorbs heat from the hot natural gas and evaporates the cooling media. The cooling medium gas output from evaporator 125 is used to power an expander 130/generator 112, which operates to cool the heated cooling media. By moving the heat from a higher temperature to a lower temperature, energy can be removed. Turbo expander 130 is a heat-to-mechanical energy converter, which reduces the pressure and removes heat from the gas, resulting in cooled gas ready to be condensed. The cooling medium is in a gas form at this point at an output of turbo expander 130 and at low pressure, e.g., 94 PSIG. While embodiments herein use this turbo expander to cool the heated cooling media and drive generator 112, other systems such as a screw expander or so forth instead may be used. For example for a system with power recovery less than approximately 1 MW, a screw expander may be used to reduce system cost and size. In embodiments with energy recovery exceeding, e.g., 1 MW, a turbo expander may be used.

Turbo expander 130 drives generator 112, which produces electricity. By way of the direct coupling of turbo expander 130 to induction generator 112, there is no need for any speed reduction gear. As such, turbo expander 130 drives induction generator 112, thus recovering mechanical energy from turbo expander 130, which cools the heated cooling media to a lower temperature, e.g., between approximately 90° and 120° F.

In another embodiment, the cooling media may be R134a. With this refrigerant, R134a may be available, for example, at 500 PSIG and 210° F. when entering turbo expander 130. At the outlet of turbo expander 130, the pressure of this cooling media may be approximately 170 PSIG, and may circulate at a flow range of 152,000 to 215,000 lb/hr.

And in an embodiment that uses R600a as the cooling media, turbo expander 130 may be configured so that the speed range may start as low as 5000 RPM. And induction generator 112 may be implemented with a lower speed machine, allowing the utilization of standard commercial machine designs.

As shown, turbo expander 130 thus outputs cooled gas or liquid media, still potentially in a two-phase condition, to condenser 140, via a conduit 135. Condenser 140, by way of forced air provided via one or more cooling fans 142, further cools and condenses the incoming cooling media into a cooled liquid. As illustrated, condenser 140 provides this cooled cooling media to a pump 150, which completes the closed loop. Pump 150 operates to pump the liquid refrigerant from 94 PSIG to 298 PSIG, which feeds it into evaporator 125 via conduit 155.

Since the cooling load from the gas compressor is not constant, cooling may be controlled. On some compressor applications, the gas cooling can be controlled. In such applications controller 160, namely a heat of compression energy (HCE) controller, would be configured to control the cooling liquid flow, and further vary the generator load to control the load on turbo expander 130 to maximize the energy recovery. On other applications where controlled cooling is not required, controller 160 will maximize the energy required without regard to gas outlet temperature. The high pressure refrigerant gas is letdown in turbo expander 130 to a lower pressure based on a predetermined flow rate and pressure drop, allowing shaft operation of induction generator 112 at 15,000 RPM.

As an example control technique, in general terms, for an amount of power (e.g., based on a step of 1000 kW) to be delivered at utility grid 105, a grid controller of MVD 114 sends a mechanical power control signal to controller 160 to produce the requested amount of active power. Controller 160 operates turbo expander 130 by regulating the flow amount of cooling medium, observing predetermined pressure and temperature at its output. Subsequently, the required output mechanical torque is developed by turbo expander 130 at a constant speed of 15000 RPM. In turn, induction generator 112 transforms mechanical power at the shaft into high frequency electrical energy, which is conditioned by MVD 114 and delivered to utility grid 105 at rated voltage, current, and frequency. As discussed above, MVD system 114 can be based on Si-based devices such as IGBT switches for low cost applications where system de-rating is permitted, i.e., for high speed and high power system applications where the output switching frequency of the silicon power devices is larger than 2 kHz. For high efficiency power conversion and reduced footprint applications, MVD system 114 may be based on SiC power devices such as SiC MOSFETs or on hybrid power converter stages combining both SiC and Si-based power devices. In another preferred embodiment, several slices can be connected in series/parallel combinations to meet a desired electrical power system rating. An MVD control system is designed to interact with utility grid 105 and energy recovery system 120 to achieve the desired performance and electrical power generation rating.

In an embodiment, a medium power building block (MPBB) is a regenerative converter system having a transformer to be operated at a 1 MW<Power<2.2 MW range. For a 1000 kW recovery system rating, the transformer can be operated at a light load point and the efficiency will be the highest. For a recovery system operating at 2.2 MW, the transformer efficiency will be at the minimum acceptable efficiency. The preferred transformer rating can be within 750 kVA-1000 kVA for a slice system. In order to balance impedances at the transformer secondary windings, windings are wound in side by side arrangement. There are three parallel primary windings for each secondary winding. Side by side arrangement of windings reduces coupling between secondary windings and also increases equivalent impedance seen by the AFE (active front end) converter stage. Extra series inductance per phase may be inserted at the transformer primary or secondary when the AFE is switched at less than 3 kHz to ensure converter control stability. The required inductance may be in the range of 5%. When the AFE is operated above 3 kHz, additional filtering may not be required but system de-rating may be mandatory to handle switching loss content and keep each IGBT cold plate within its boundaries (e.g., <1400 W).

Still with reference to FIG. 1, note the presence of various control and communication paths between converter and generator system 110 (and more specifically medium voltage drive 114 and a local grid communication endpoint, circuit breaker 115 and recovery controller 160). Understand although shown at this high level in the embodiment of FIG. 1, many variations and alternatives are possible.

While energy recovery system 120 of FIG. 1 advantageously recovers much heat energy that would otherwise be lost, other implementations may extract even further electrical energy from heat energy.

Figure 2:
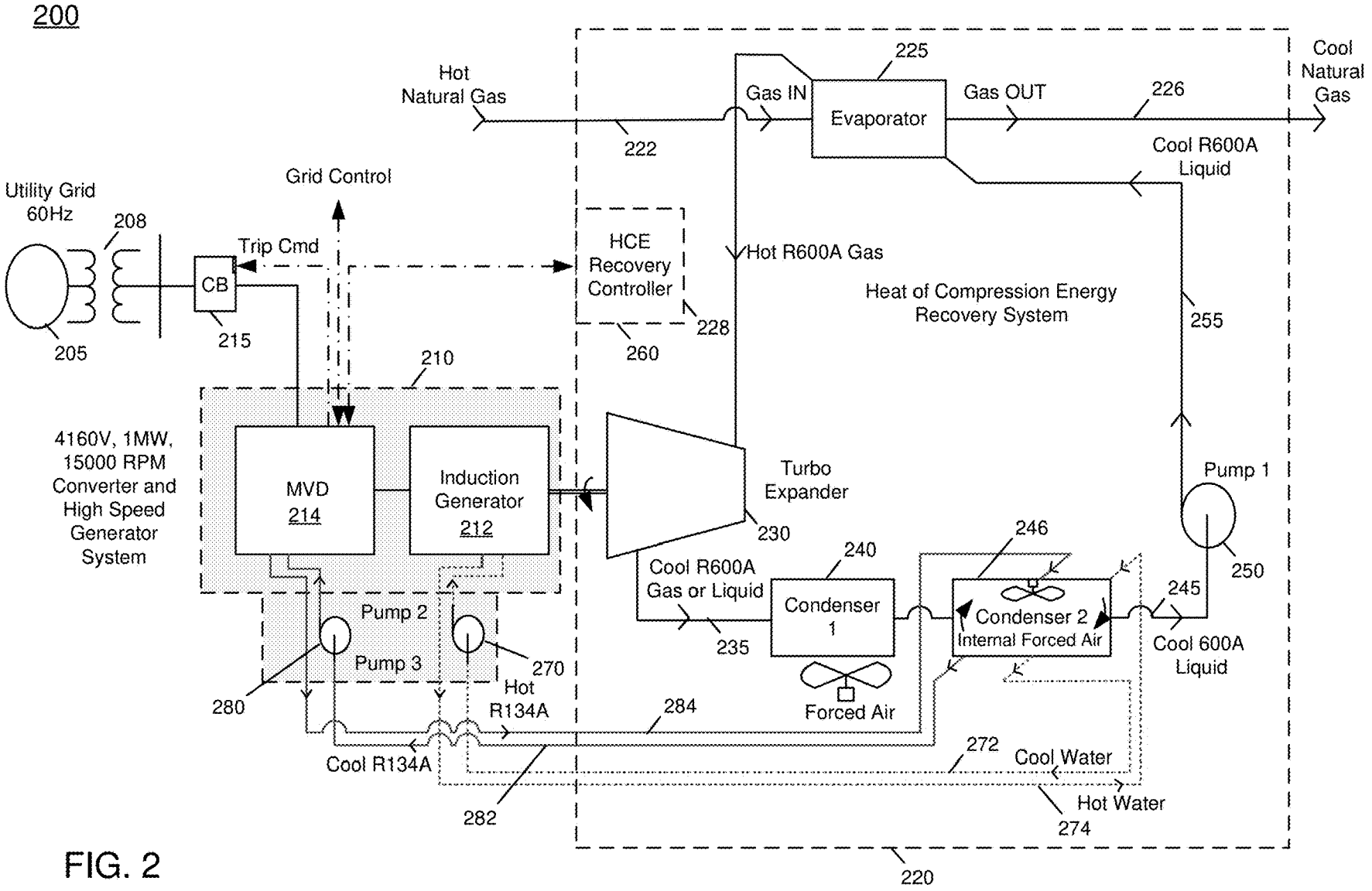
FIG. 2 is a block diagram of an energy recovery system in accordance with another embodiment.

Referring now to FIG. 2, shown is a block diagram of an energy recovery system in accordance with another embodiment of the present invention. In FIG. 2, like reference numerals are used to refer to the same components as in the FIG. 1 embodiment and as such, details of the overall general arrangement are not discussed (note that these reference numerals are of the "200" series, rather than the "100" series as in FIG. 1).

In the embodiment of FIG. 2, additional energy may be recovered from components present in converter and generator system 210. This is so, as during operation, particularly at high speeds, constituent components of the system 210, including medium voltage drive system 214 and induction generator 212 may generate significant amounts of heat.

To recover at least portions of this heat generated, pumps and various conduits may be provided to enable cooling media that flows through MVD system 214 and induction generator 212 to be communicated to and from recovery system 220 such that electrical energy may be recovered from this heat. More specifically as illustrated in FIG. 2, a pump 270 couples to a set of conduits extending from induction generator 212, and provides a flow of cooled cooling media, e.g., water-based media, from an additional condenser 246 present within recovery system 220. Thus as shown, pump 270 receives, via a conduit 272, a flow of cooled cooling media, namely cool water, that is provided by condenser 246. In embodiments, this cool water may be at a temperature of between approximately 90° and 120° F. Condenser 246, which may operate using internal forced air, operates as a heat exchanger to cool an incoming flow of cooling media, namely hot water, received from induction generator 212 via another conduit 274. In an embodiment, this hot water may flow from induction generator 212 at a temperature of between approximately 90° and 122° F.

A similar arrangement of an additional pump 280 is provided in association with MVD system 214. As illustrated, pump 280 couples to a set of conduits extending from MVD system 214, and receives a flow of cooled cooling media, e.g., R134a, from condenser 246 of recovery system 220. Thus as shown, pump 280 receives, via a conduit 282, a flow of cooled cooling media, namely cool R134a, that is provided by condenser 246, which it in turn provides to MVD system 214. In embodiments, this R134a may be at a temperature of between approximately 90° and 122° F. Condenser 246 also operates to cool incoming heated R134a flow of cooling media received from MVD system 214 via another conduit 284. In an embodiment, this hot R134a may flow from MVD system 214 at a temperature of between approximately 90° and 122° F.

Note that in the embodiment of FIG. 2, condenser 240 may be an optional condenser. Where present, controller 260 may control condenser 240 as a tuning element to adjust dynamically a temperature of coolant liquid output from turbo expander 230 that in turn passes to condenser 246.

With an arrangement as in FIG. 2, additional conversion of heat energy created in converter and generator system 210 may be recovered and converted into electrical energy as described herein. And in other implementations, it is possible for only a single one of these pumps and corresponding conduit systems to be provided to enable extraction of energy from heat for only one of the components of converter and generator system 210. In other aspects, system 200 may operate substantially the same as system 100 of FIG. 1. Although shown at this high level in FIG. 2, understand that many variations and alternatives are possible.

Figure 3:
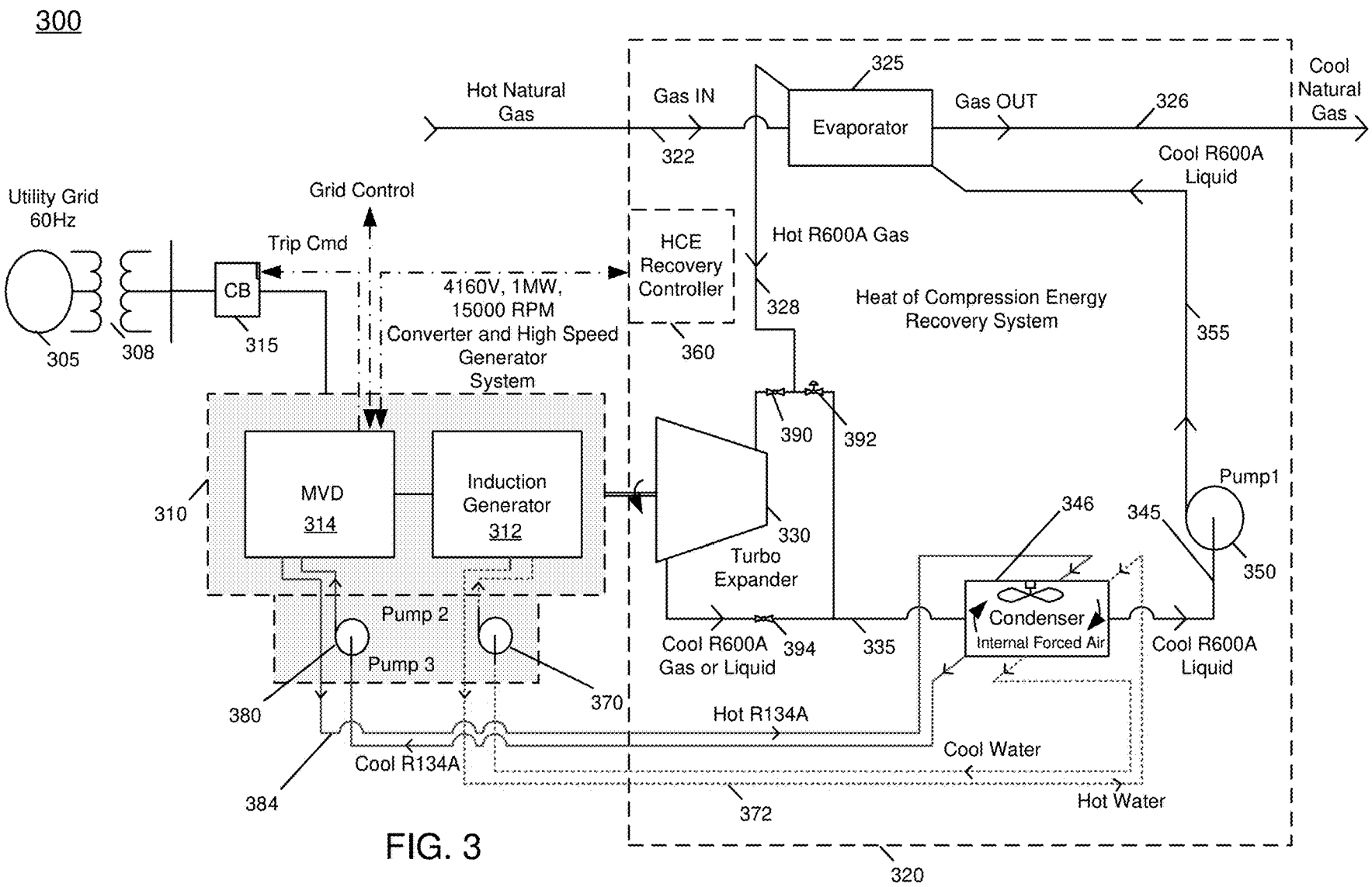
FIG. 3 is a block diagram of an energy recovery system in accordance with yet another embodiment.

To this end, it is possible to provide for various bypass paths within a converter system to enable dynamic control, e.g., based on operating conditions such as temperature, pressure or so forth. Referring now to FIG. 3, shown is a block diagram of an energy recovery system in accordance with yet another embodiment. In FIG. 3, like reference numerals are used to refer to the same components as in the FIG. 2 embodiment and as such, details of the overall general arrangement are not discussed (note that these reference numerals are of the "300" series, rather than the "200" series as in FIG. 2).

At system start up some systems will require a bypass of all or a portion of the feedback loop within recovery system 320, note the presence of valves 390, 392 and 394. Note that these valves may be controlled by controller 360. For example, based on temperature and/or pressure conditions at point 335, controller 360 may cause at least a portion of the hot gas exiting evaporator 325 to bypass input into turbo expander 330, by appropriate control of one or more of valves 390, 392, 394. Note that valves 392 and 394 act as both bypass and pressure control valves.

Note further that in the embodiment of FIG. 3, the additional condenser is removed. That is, with appropriate bypass control realized, the need for a tuning condenser to provide for a controllable heat exchange (such as the embodiment of FIG. 2) may be avoided. In other aspects, system 300 may operate substantially the same as system 200 of FIG. 2.

Figure 4:
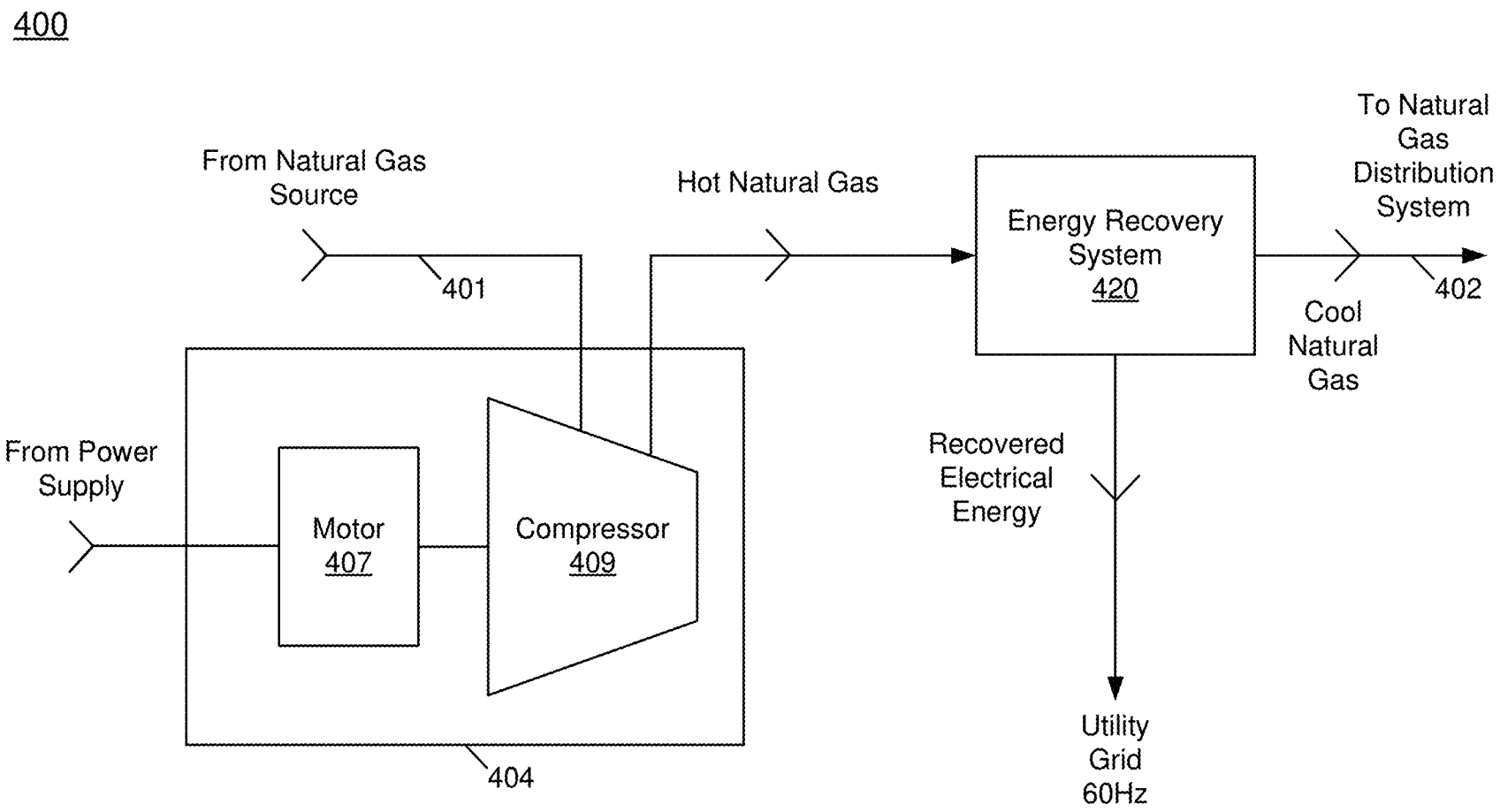
FIG. 4 is a block diagram of a system in accordance with another embodiment of the present invention.

Referring now to FIG. 4, shown is a block diagram of a system in accordance with another embodiment of the present invention. As shown in FIG. 4, system 400 may be any type of industrial arrangement, such as a natural gas distribution facility, factory, geothermal power facility or so forth.

In the particular embodiment illustrated in FIG. 4, system 400 is a natural gas distribution facility that compresses incoming natural gas and provides the compressed gas to a distribution system. Thus as illustrated, incoming natural gas from a natural gas source is received via an input conduit 401. Conduit 401 feeds a compression system 404. As illustrated, compression system 404 includes a motor 407 that receives power from a power supply and provides power to a compressor 409 that compresses the natural gas into compressed natural gas, which results in an increased temperature of the natural gas.

As further illustrated in FIG. 4, this hot compressed natural gas output from compression system 404 is provided to an energy recovery system 420. In various embodiments, energy recovery system 420 may take the form of the recovery systems shown in any one of FIGS. 1-3. In this way, heat may be removed from the natural gas and energy can be recovered, which is provided to a utility grid, e.g., at 60 Hz. In turn, energy recovery system 420 outputs cooled natural gas to a natural gas distribution system via an output conduit 402. Understand while shown at this high level in the embodiment of FIG. 4, many variations and alternatives are possible.

While the present invention has been described with respect to a limited number of embodiments, those skilled in the art will appreciate numerous modifications and variations therefrom. It is intended that the appended claims cover all such modifications and variations as fall within the true spirit and scope of this present invention.

What is claimed is:

1. A system comprising:

an evaporator to receive, from a compressor, a flow of natural gas at a first temperature and to output, to a natural gas distribution system, the flow of natural gas at a second temperature lower than the first temperature, the evaporator further to receive a flow of cooling media to cool the natural gas and to output a flow of heated cooling media;

a heat-to-mechanical energy converter coupled to the evaporator to receive the flow of heated cooling media and to output first cooled cooling media;

an induction generator to be driven by the heat-to-mechanical energy converter;

a medium voltage drive to receive power from the induction generator and to condition the power for output to a utility grid;

a condenser to condense the first cooled cooling media to provide the flow of cooling media to the evaporator; and a controller to control operation of the heat-to-mechanical energy converter to enable the medium voltage drive to provide a requested output of the power.

2. The system of claim 1, wherein the controller is to control the flow of cooling media to control the operation of the heat-to-mechanical energy converter.

3. The system of claim 1, wherein the controller is to receive a control signal from the medium voltage drive to indicate the requested output of the power.

4. The system of claim 1, further comprising a bypass system, wherein the controller is to control the bypass system to cause at least a portion of the flow of heated cooling media to bypass the heat-to-mechanical energy converter.

5. The system of claim 1, wherein the evaporator is to receive the flow of cooling media comprising a liquid refrigerant and to output the flow of heated cooling media comprising a gas refrigerant.

6. The system of claim 1, wherein the medium voltage drive comprises a hybrid power converter having at least some silicon-based switches and least some silicon carbide-based switches.

7. The system of claim 1, wherein the medium voltage drive comprises a regenerative converter comprising a transformer having a plurality of parallel primary windings associated with a secondary winding.

8. The system of claim 7, wherein the medium voltage drive is directly coupled to the induction generator.

9. The system of claim 1, wherein the system is further to recover energy from heat generated by at least one of the medium voltage drive and the induction generator.

10. The system of claim 9, further comprising a second condenser to provide a flow of second cooling media to the medium voltage drive and receive a flow of heated second cooling media from the medium voltage drive.

11. The system of claim 10, wherein the controller is to control the second condenser to dynamically adjust a temperature of the first cooled cooling media from the heat-to-mechanical energy converter.

12. The system of claim 10, wherein the second condenser is further to provide a flow of third cooling media to the induction generator and receive a flow of heated third cooling media from the induction generator.

13. A method comprising:

receiving, in an evaporator of an energy recovery system, a flow of compressed natural gas, cooling the compressed natural gas in the evaporator using a flow of cooling media, and outputting to a distribution system the flow of the compressed natural gas at a second temperature lower than the first temperature;

providing a flow of heated cooling media from the evaporator to a turbo expander of the energy recovery system;

driving, via the turbo expander, an induction generator coupled to the turbo expander using the flow of heated cooling media;

receiving, in a medium voltage drive system coupled to the induction generator, power from the induction generator, conditioning the power, and delivering the conditioned power to a utility grid coupled to the medium voltage drive system via a point of common coupling;

outputting cooled cooling media from the turbo expander to a condenser coupled to the turbo expander; and condensing the cooled cooling media to provide the flow of cooling media to the evaporator.

14. The method of claim 13, further comprising controlling at least one of a flow rate and a pressure drop in the turbo expander to cause a shaft of the induction generator to operate at a substantially steady rate.

15. The method of claim 13, further comprising:

providing, from a second condenser, a flow of second cooling media to the medium voltage drive system;

receiving a flow of heated second cooling media from the medium voltage drive system; and cooling the heated second cooling media.

16. The method of claim 15, further comprising:

providing, from the second condenser, a flow of third cooling media to the induction generator;

receiving a flow of heated third cooling media from the induction generator; and cooling the heated third cooling media.

17. A natural gas distribution system comprising:

a compressor to compress natural gas to output compressed natural gas at a first temperature;

an evaporator to receive the compressed natural gas at the first temperature and to output to a distribution system the compressed natural gas at a second temperature lower than the first temperature, the evaporator to receive a flow of cooling media to cool the compressed natural gas and to output a flow of heated cooling media;

an expander coupled to the evaporator to receive the flow of heated cooling media and to output cooled cooling media;

an induction generator to be driven by the expander;

a medium voltage drive to receive power from the induction generator and to condition the power for output to an electrical distribution system;

a condenser to condense the cooled cooling media to provide the flow of cooling media to the evaporator; and a controller to control a flow rate of the flow of heated cooling media to the expander based at least in part on feedback information regarding the cooled cooling media.

18. The natural gas distribution system of claim 17, wherein the controller is further to control a bypass system coupled between the evaporator, the expander and the condenser, wherein the controller is to cause at least a portion of the flow of heated cooling media to bypass the expander.

19. The natural gas distribution system of claim 17, further comprising a second condenser to provide a flow of second cooling media to the medium voltage drive and receive a flow of heated second cooling media from the medium voltage drive.

20. The natural gas distribution system of claim 17, wherein the controller is to receive a control signal from the medium voltage drive to request the power, the controller to control the flow rate further based on the control signal.

* * * * *